United States Patent [19]
Reed et al.
[11] 4,220,444
[45] Sep. 2, 1980

[54] GAS BURNER FOR FLAME ADHERENCE TO TILE SURFACE

[75] Inventors: Robert D. Reed; Hershel E. Goodnight, both of Tulsa, Okla.

[73] Assignee: John Zink Company, Tulsa, Okla.

[21] Appl. No.: 881,772

[22] Filed: Feb. 27, 1978

[51] Int. Cl.[2] ..... F23M 9/00
[52] U.S. Cl. ..... 431/348; 239/399; 239/406; 431/183
[58] Field of Search ..... 431/347, 329, 348, 181–185; 239/399, 406

[56] References Cited

U.S. PATENT DOCUMENTS

| | | | |
|---|---|---|---|
| 2,571,336 | 10/1951 | Buckholdt | 431/347 |
| 3,007,512 | 11/1961 | Nuyl et al. | 431/183 |
| 3,022,815 | 2/1962 | Bloom et al. | 431/185 |
| 3,115,924 | 12/1963 | Massier | 431/185 |
| 3,154,134 | 10/1964 | Bloom | 431/348 |
| 3,267,984 | 4/1966 | Reed et al. | 431/185 |
| 3,299,841 | 1/1967 | Hemker et al. | 431/183 |
| 3,726,633 | 4/1973 | Vasilakis et al. | 431/329 |
| 3,922,137 | 11/1975 | Pegzeli et al. | 431/183 |

*Primary Examiner*—Samuel Scott
*Assistant Examiner*—Wesley S. Ratliff, Jr.
*Attorney, Agent, or Firm*—Head & Johnson

[57] ABSTRACT

A gaseous fuel burner for enhanced flame adherence to a tile surface in a furnace, comprising a gas burner tube having a nozzle at its end, including a plurality of radial orifices circumferentially spaced in a transverse plane. A cylindrical combustion air plenum is coaxial with said burner tube, and means are provided to supply combustion air to said plenum at a selected super-atmospheric pressure P1. There is a circular concentric opening in the wall of the plenum and a short length of air tube welded to the opening, which is inserted into an opening in the furnace tile. A plurality of curved vanes are provided, and means to lead air from the pressurized plenum through the vanes to provide a rapidly spinning air flow which moves helically along the air tube into the tile and into the furnace. The central opening of the tile is flared in an arcuate manner. There is sufficient pressure drop between the air plenum at P1 and inside of the air tube P2, after passage through the vanes, of the order of 0.8 W.C. so that a tangential air velocity of as high as 100 feet per second is possible. This rapidly spinning air volume has fuel injected into it under pressure through the radial orifices, and flows into the furnace in an expanding spiral flow along the arcuate portion of the tile. Because of the high tangential velocity of the air, gas and flame, the pressure at the face of the tile is low and the flame is held in close contact with the tile causing rapid heat transfer to the tile which then radiates into the furnace area.

3 Claims, 6 Drawing Figures

GAS BURNER FOR FLAME ADHERENCE TO TILE SURFACE

BACKGROUND OF THE INVENTION

1. Field of the Invention

This invention lies in the field of gaseous fuel burner systems. More particularly, it is concerned with a gaseous fuel burner which is designed to provide flame adherence to the surface of a refractory tile, so that rapid heat transfer from the flame to the tile is provided, which heat is radiated from the tile to all portions of the furnace being fired.

2. Description of the Prior Art

In conventional gaseous fuel furnaces or oil-fired furnaces, the fuel orifices are directed at a small conical angle from the axis of the fuel supply tube and the flame progresses as a conical wall into the furnace enclosure. Where the horizontal distance between the burner and the tubes of the boiler is short, there is often damage done to the metal of the tubes by the contact of hot flame.

In this invention strong flame adherence is provided to the surfaces of the tile, in the region of the burner so that the tile is heated and consequently provides a rich source of radiant heat energy to the boiler tubes without a significant flame movement from the burner in the forward direction (downstream flame movement).

SUMMARY OF THE INVENTION

It is a primary object of this invention to provide a burner system for a furnace and boiler, in which the flame that is generated from a source of gaseous fuel and air, flows in the form of a rapidly expanding spiral in which there is high tangential velocity of flow, and close adherence of the flame to the surface of the tile. Thus, the flame, as it expands outwardly from the axis of the burner and flows along the arcuately flared surface of the tile, is held in intimate contact with the tile surface and, thus, provides high heat transfer capability, so that the major part of the heat recovered from the flame is transmitted to the tile and is re-transmitted to the boiler tubes by radiation.

These and other objects are realized and the limitations of the prior art are overcome in this invention, by providing a large refractory tile at the point at which the burner is situated in the wall of the furnace. The refractory tile has a central opening of selected diameter and selected length. The opening then flares outwardly with an arcuate surface to the front surface of the tile.

The gaseous fuel burner comprises a gas burner tube which is coaxial with the central opening of the tile. The burner tube is terminated with a nozzle structure, which provides a plurality of radial orifices, equally spaced circumferentially, in a transverse plane. Thus, the jets of gaseous fuel flow out perpendicular to the circumferential surface of the nozzle. The nozzle also has a flange at its upstream end, which narrows the annular space available for the flow of combustion air. This flange also causes the generation of eddies behind the flange which provides good mixture of the air and the gas for optimum combustion.

A cylindrical air plenum is provided, which is coaxial with, and surrounds the gas burner tube. This cylindrical plenum is attached to the wall of the furnace and includes an opening on the downstream end with a projecting air tube which fits into the central opening of the tile. Air under a selected super-atmospheric pressure P1 is supplied to the plenum, and is directed by flange means to and through the spaces between a plurality of curved vanes, such that, as the air flows from P1 through the vanes to a lower pressure P2, its velocity is increased, and it is given a circular spinning motion of high tangential velocity. The pressure drop through the vanes may be of the order of 0.8" W.C., which would provide a tangential velocity of as high as 100 FPS.

This spinning air now flows in a helical manner down the air tube and around the gaseous fuel tube to the plane of the nozzles where the gaseous fuel is injected by high velocity jets into the tangentially spinning air, to provide a spinning flame, which flows through the opening in the tile and as an expanding spiral along the surface of the flared arcuate portion, to larger and larger radius of rotation.

It is well known that, where the velocity of flow of a gas or a flame along a surface is high, there will be a low pressure in the space between the gas flow and the surface, causing an adherence of the flame to the surface, which, moving at high velocity, will transfer heat to the surface by convection. The surface of the tile will be heated to a high temperature and will, in balance, transfer the heat by radiation to the boiler tubes and walls of the furnace.

An improved operation, in the sense of maintaining a continuously ignited flame, is obtained by cutting a circumferential groove of rectangular cross-section along the inner surface of the central opening in the tile, just at the downstream edge of the air tube. The sudden expansion of the flow area past the end of the air tube causes eddies to flow into the groove, and to slow their velocity so that a stable burning flame is provided within the groove, which serves to continually reignite the high velocity spinning air and gas mixture because, due to the energy of the gaseous fuel as discharged from the plurality of transversely directed fuel gas ports, a portion of the transversely directed fuel gas traverses the spinning air flow to move into the groove where, due to eddy action, the gaseous fuel burns with great stability.

BRIEF DESCRIPTION OF THE DRAWINGS

These and other objects and advantages of this invention and a better understanding of the principles and details of the invention will be evident from the following description taken in conjunction with the appended drawings in which.

Figure 2:
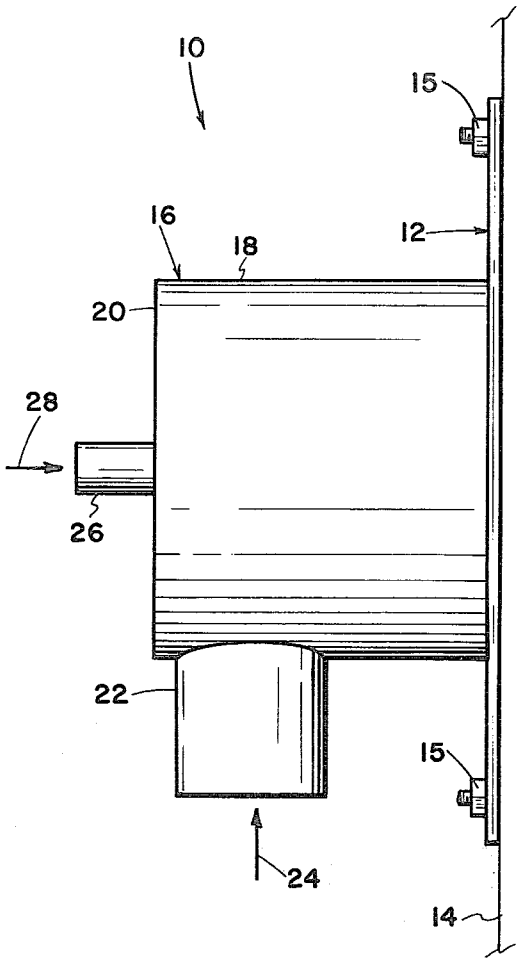
FIGS. 1 and 2 show two elevation views of the exterior of the burner of this invention.
Figure 1:
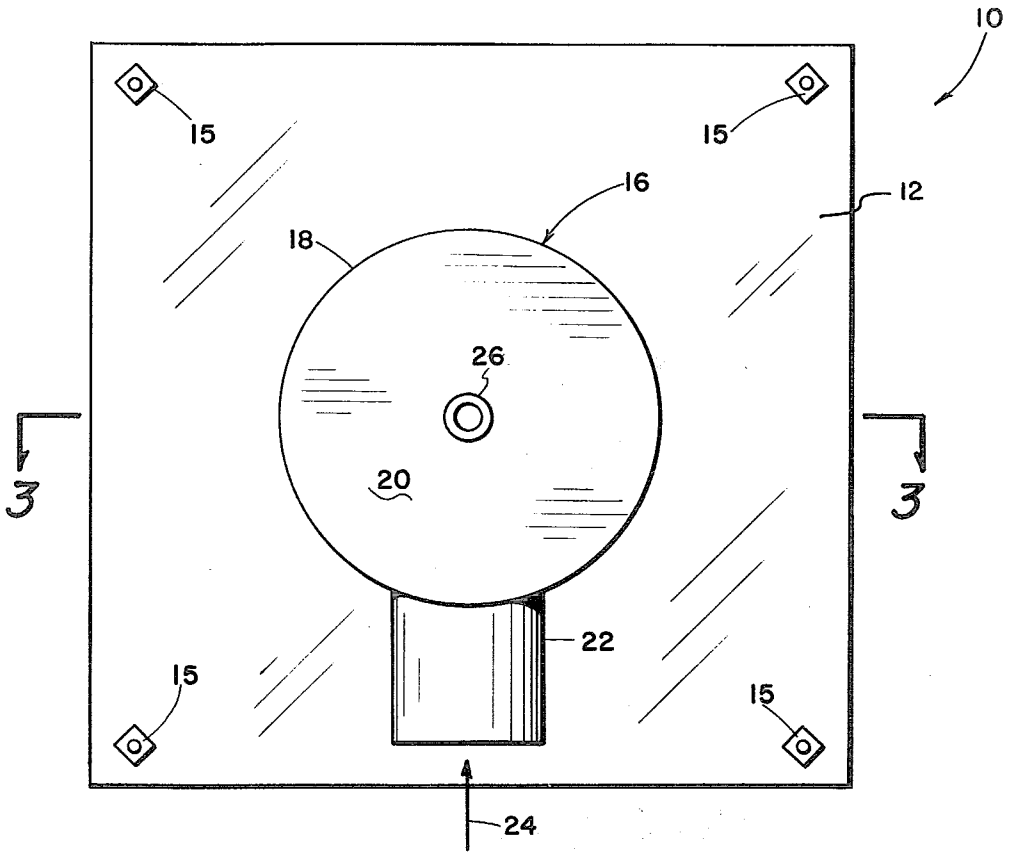

Referring now to the drawings and, in particular, to FIGS. 1 and 2, there are shown exterior elevation views of the burner system of this invention. The burner is indicated generally by the numeral 10 and comprises a mounting plate 12, by means of which it is attached to the outer wall 14 of a furnace. There is a circular cylindical housing or plenum, indicated generally by the numeral 16, which includes a cylindrical wall 18 attached to the plate 12, and having an end closure 20. A gaseous fuel pipe or fuel tube 26 is mounted coaxially through the plenum and extends into the furnace as will be described fully in connection with FIG. 3. Air is supplied through a pipe 22 cut into the sidewall of the air plenum 16, in accordance with arrow 24 under a selected input pressure P1 in the plenum.

Figure 3:
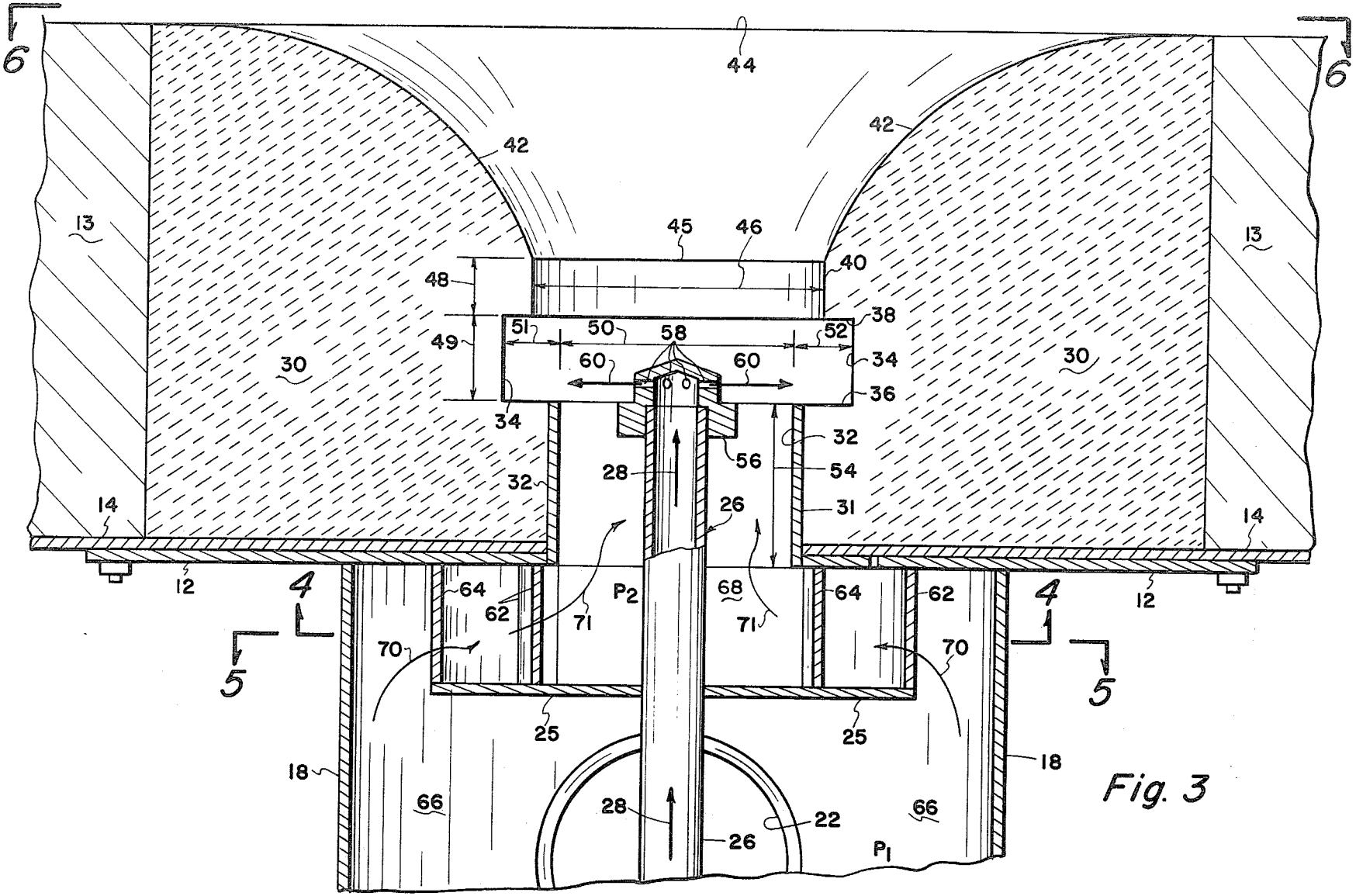
FIG. 3 is a cross-section of the burner system and furnace wall taken across the plane 3—3 of FIG. 1.

Referring now to FIG. 3, there is shown in horizontal cross-section a view of the furnace wall 13, including a large square or circular tile 30 having a downstream face 44, which is co-planar with the face of the furnace wall 13. There is a circular opening 31 in the middle of the tile 30.

The burner plenum 16 has a cylindrical wall 18, which is welded to the mounting plate 12, by means of which the burner is attached to the steel plate 14 of the burner wall by means well known in the art. A gas supply tube or burner tube 26 is mounted coaxial in the back plate 20 of the plenum and there is an air tube 32 which is a steel pipe, of larger diameter than length, and of such diameter as to fit snugly into the opening 31 inside of the refractory tile 30.

Inside of the plenum in the space 66 near the open entrance to the air tube 32, is a plurality of curved vanes 62 and 64 which will be described more fully in connection with FIGS. 4 and 5. A circular plate 25 is fastened to the upstream edges of the vanes 62 and 64 which plate 25 serves to guide the combustion air from the plenum chamber 66 at pressure P1 into the vanes and between the vanes to a space 68 which is at some lower pressure P2.

This drop in pressure causes a great increase in air velocity, and the curvature of the vanes forces the air to spin in a circumferential manner at very high velocity, of the order of 100 FPS. This spinning air in the space 68 inside of the vanes moves downstream into the tube 32 and in the form of a helix, along the tube and into the furnace.

The end of the gas burner tube 26 in which the gas flows in accordance with the arrows 28, carries a nozzle 56 which includes a cap and flange. The cap has a plurality of radial orifices 58 drilled in a transverse plane, equally spaced circumferentially. Thus, the gas 28 under pressure flows outwardly from the orifices in the form of high velocity radial jets of gas indicated by the arrows 60.

Immediately at the downstream edge of the air tube 32 is a rectangular groove cut into the inner surface of the central opening 31 of the tile. Thus, there is a transverse wall 36, a cylindrical wall 34 and another transverse wall 38. This latter is of shorter height and joins a short cylindrical wall 40, which at the plane 45 joins an arcuate surface 42 which flares out, and becomes asymptotic with the front surface 44 of the tile.

It will be clear that, as the spinning helical flow of air moves down the air tube 32, it will face a restriction in the form of the flange of the nozzle 58, and then will find an expansion both inwardly due to the back edge of the flange, and outwardly due to the groove cut in the tile. These sharp expansions will provide eddies, which promote mixing of the spinning air with the gas jets 60.

Furthermore, inside the groove there will be a comparatively stable air supply of low velocity due to the eddies. Consequently, there will be a maintenance flame, which will be stable, and which will serve to continually ignite the high velocity flowing air and gas which mix downstream of the plane of the orifices and expand along the walls 40 and 42.

As the burning gas moves in a spiral outwardly along the wall 42, the high velocity causes a reduction in pressure in the space in between the gas flow and the surface, and this low pressure forces the flame and air to adhere strongly to the surface of the tile, and to transmit heat by convection in a rapid heat transfer manner to the tile, which is heated to a high temperature and transmits heat by radiation outwardly to the furnace walls, over a wide area, in substantially all directions.

In FIG. 3 the flow of air from the plenum space 66 behind the plate 25 and into the vanes is illustrated by the arrows 70, thorugh the vanes 62 and 64, into the space 68, which is at a reduced pressure P2, below P1, and then in a swirling helical manner inside of the air tube 32 and downstream toward the orifices.

While there is no specific limitation on the dimensions of the burner, some sample dimensions will serve to indicate the general size of the various elements. For example, the diameter of the air tube 32 may be of the order of 4 inches with the gas tube 26 being of the order of a ¾-inch pipe, for example. The ratio of length 54 to diameter 50 of the air tube 32 would be the order of 0.75, which, if the diameter is 4 inches, would make the length 54 about 3 inches. The groove in the inner surface of the tile could be at a depth 52 of 1 inch to the circumferential wall 34, and the width 49 of the groove of about 1½ inches. The depth of the groove at the wall 40 is about ½ inch and, thus, the aperture 46 of the cylindrical part 40 would be about 5 inches and the length of the cylindrical portion 40, shown by dimension 48 would be about 1 inch.

Figure 4:
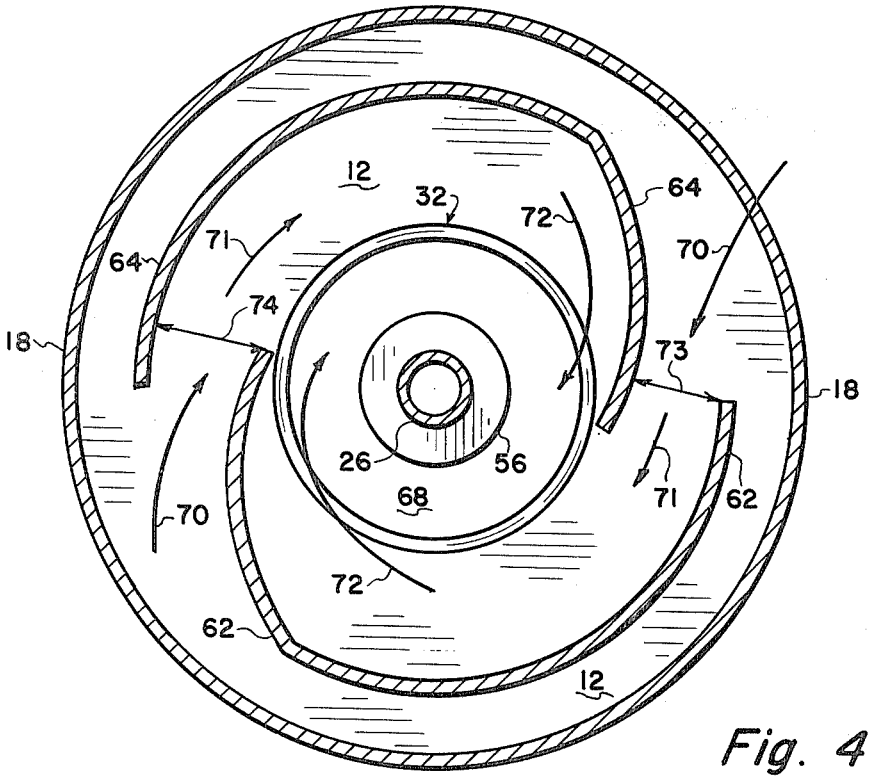
FIGS. 4 and 5 are cross-sections taken across the planes 4—4 and 5—5, respectively, of FIG. 3.

Reference is now made to FIG. 4, which is a cross-section taken along the plane 4—4 of FIG. 3. This is a view through the vane structure, looking into the air tube and the burner, etc. The outer circle 18 represents the circumferential wall of the air plenum. The inner circle 26 represents the gas burner tube and 56 represents the nozzle structure and the flange. The circle 32 represents the air tube. While there are two vanes 62 and 64 shown, there can be any number desired, to provide a means for converting static pressure of the air in the space 66 at P1, into a high velocity spinning motion at reduced pressure P2 in the space 68 inside of the vanes.

Air flows into the vanes in accordance with arrows 70 and 71 increasing in velocity as the pressure is reduced, finally flowing in accordance with arrows 72 in a tight helix, flowing axially inside of the air tube 32.

Figure 5:
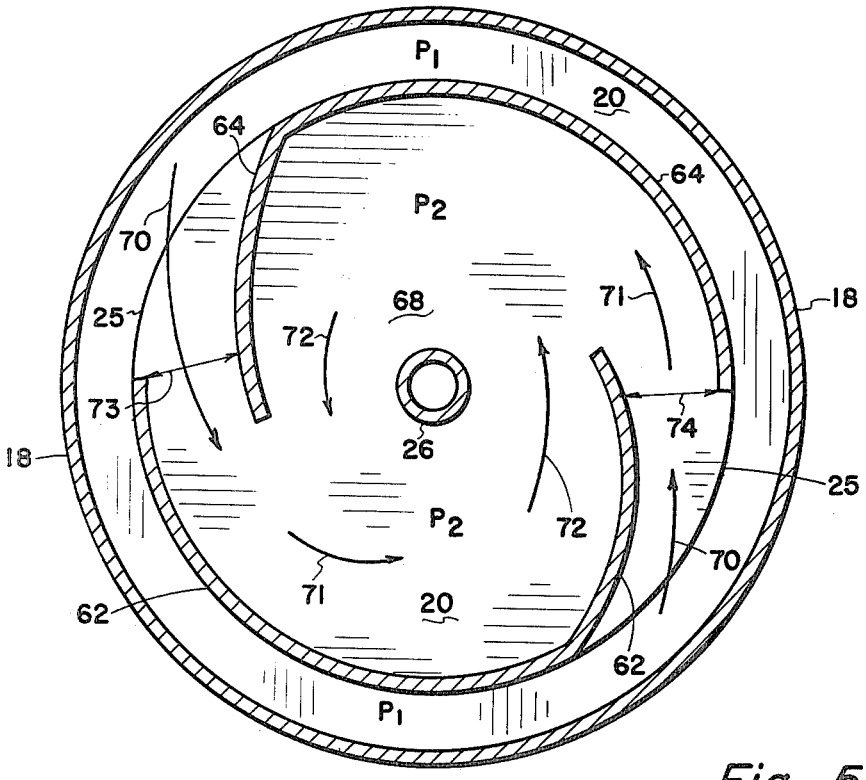

Referring now to FIG. 5, which is a cross-section taken along the plane 5—5 of FIG. 3, the vanes 62 and 64 are again shown. The circle 25 indicates the cover plate 25. Again, the air flow in accordance with arrows 70, 71 and 72 from the air plenum at pressure P1 through the vanes and into the internal volume 68 at pressure P2, and with high spinning velocity into the air tube 32.

Figure 6:
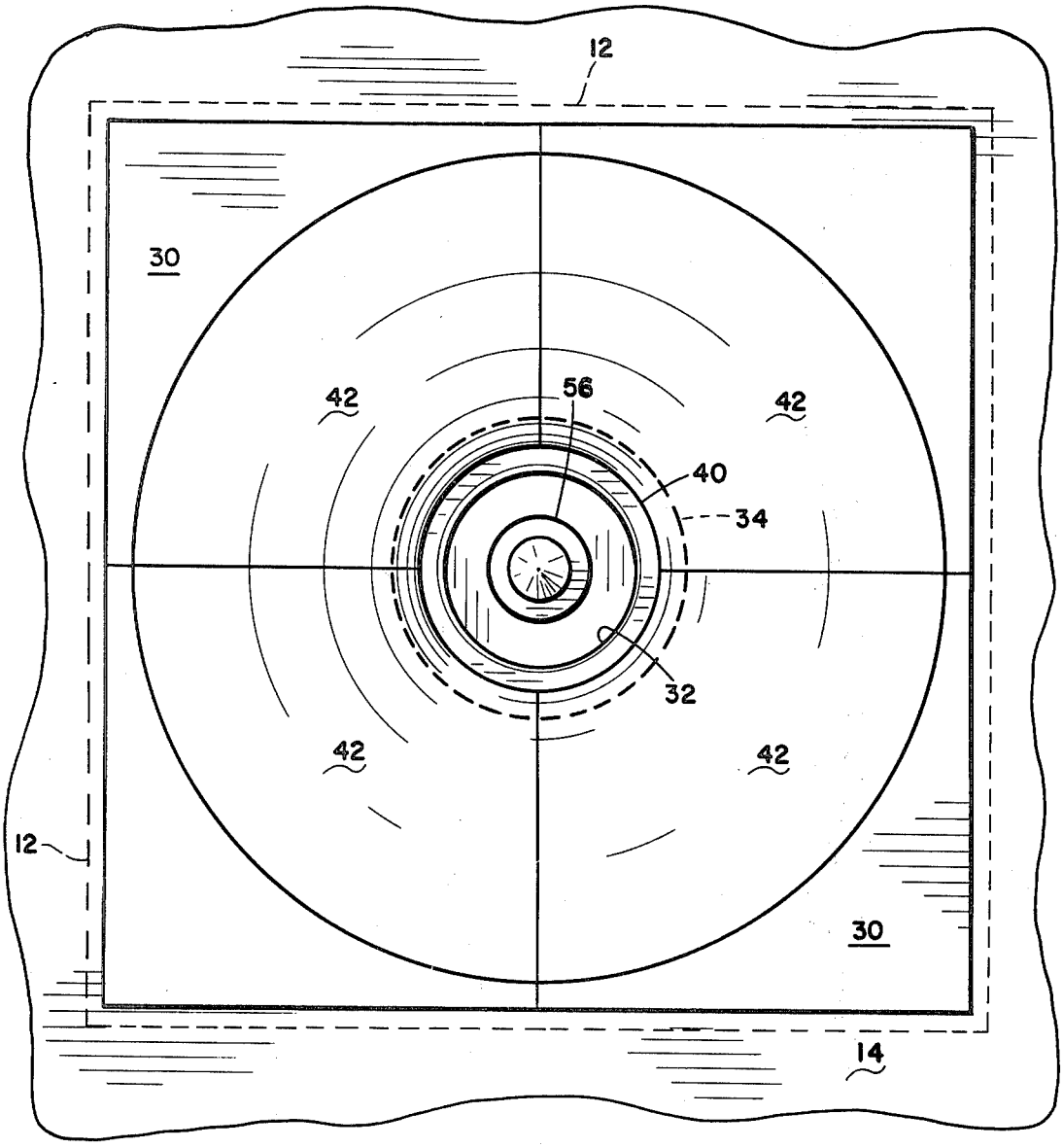
FIG. 6 is a view taken along the plane 6—6 of FIG. 3.

Referring now to FIG. 6, there is shown a view taken along the plane 6—6 of FIG. 3, which is an elevation view of the tile 30 with the arcuate flared surface 42. Numeral 56 indicates the nozzle on the gas supply tube. 32 indicates the air tube. The circle 40 indicates the wall 40 of FIG. 3, and the dashed circle 34 indicates the cylindrical surface 34 of the groove.

What has been described is a gaseous fuel burner system, which, in conjunction with a refractory tile inlet to the furnace having an arcuate flare on the inner surface, a high velocity spirally rotating flow of air, gas, and flame is directed against the arcuate surface of the tile, which adheres thereto, as it flows outwardly, thereby heating the tile to a very high temperature. The tile radiates heat to substantially the entire interior of the furnace.

Means are also provided for having a shielded circumferential volume inside the tile, in which a quiet flame can be maintained in stable condition, which serve as a means of continual ignition of the rapidly flowing air, fuel and flame.

The discharge of fuel gas from the plural gas ports 58, from the gas supply pressure in the fuel tube 26, provides gas jet velocities radially outwardly toward the groove; of at least 25% of critical velocity for the fuel gas being burned. The internal pressure upstream of the ports should be at least 1 psi gauge.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. A gaseous fuel burner for enhanced flame adherence to an outwardly flared tile surface in a furnace, having a gaseous fuel burner tube having a nozzle at its distal end, and a plurality of radial orfices, circumferentially spaced, in a transverse plane;

a circular flange about the burner tube upstream of the orifice plane, to restrict the annular area for air flow, and to create an eddy zone downstream of the flange;

a cylindrical combustion-air plenum, coaxial with the burner tube;

means to supply combustion air to the plenum at a selected super-atmospheric pressure P1;

a circular concentric air tube opening in the distal wall of the plenum coaxial with the plenum and the burner tube;

vane means in the plenum to provide rapidly spinning air moving helically along the air tube, the improvement characterized by a circumferential groove cut into the tile of a diameter larger than the air tube and positioned downstream of the circular flange and opposite the radial orifices of the burner tube.

2. The burner of claim 1, the further improvement characterized by the downstream edge of the flange in the same plane as the upstream edge of the groove.

3. The burner of claim 1, the further improvement characterized by a cylindrical surface in the tile of diameter less than the groove but greater than the air tube and located between the downstream end of the groove and the upstream edge of the outwardly flared surface.

* * * * *